US012473697B2

(12) United States Patent
Vachon

(10) Patent No.: US 12,473,697 B2
(45) Date of Patent: Nov. 18, 2025

(54) PADDING LAYER FOR ATHLETIC FIELD FOR WATER RETENTION AND DRAINAGE

(71) Applicant: SAFEPLAY LLC, Cedar Park, TX (US)

(72) Inventor: Frédéric Vachon, Montreal (CA)

(73) Assignee: TENCATE GRASS HOLDING BV, Nijverdal (NL)

( * ) Notice: Subject to any disclaimer, the term of this patent is extended or adjusted under 35 U.S.C. 154(b) by 760 days.

(21) Appl. No.: 17/757,372

(22) PCT Filed: Dec. 21, 2020

(86) PCT No.: PCT/IB2020/062289

§ 371 (c)(1),
(2) Date: Jun. 15, 2022

(87) PCT Pub. No.: WO2021/130656

PCT Pub. Date: Jul. 1, 2021

(65) Prior Publication Data

US 2023/0008205 A1 Jan. 12, 2023

Related U.S. Application Data

(60) Provisional application No. 62/953,006, filed on Dec. 23, 2019.

(51) Int. Cl.
*E01C 13/02* (2006.01)

(52) U.S. Cl.
CPC ..... *E01C 13/02* (2013.01); *E01C 2201/205* (2013.01)

(58) Field of Classification Search
CPC ..... E01C 13/02; E01C 2201/205
See application file for complete search history.

(56) References Cited

U.S. PATENT DOCUMENTS 4,436,779 A * 3/1984 Menconi ..... E04F 15/105 428/44
7,645,501 B2 1/2010 Sawyer et al.
(Continued)

FOREIGN PATENT DOCUMENTS

| | | | |
|---|---|---|---|
| CN | 1776100 | A | 5/2006 |
| DE | 19911409 | A1 | 9/2000 |
| KR | 20110080466 | A | 7/2011 |

OTHER PUBLICATIONS

International Search Report for International Application No. PCT/IB2020/062289 mailed Jul. 1, 2021.
(Continued)

*Primary Examiner* — Abigail A Risic
(74) *Attorney, Agent, or Firm* — Perilla Knox & Hildebrandt LLP; James J. Rha

(57) ABSTRACT

Various embodiments for a panel that may be combined with other similar panels to form a padding layer of an athletic field, or other surface, are disclosed. The panel for use in a padding layer of a panel system includes at least one water accumulation region positioned at or near a perimeter of the panel. The at least one water accumulation region is defined by a pyramidal surface that slopes downwards from a center of the panel to distal edges of the panel such that the center has a height relative to a ground surface greater than the distal edges of the panel, a plurality of projections projecting from the pyramidal surface, and a ridge projecting from the pyramidal surface, the ridge extending along a perimeter of the panel, wherein the ridge has a projection height sufficient to retain water at the perimeter of the panel.

15 Claims, 9 Drawing Sheets

(56) References Cited

U.S. PATENT DOCUMENTS

| | | | | |
|---|---|---|---|---|
| 7,662,468 | B2 | 2/2010 | Bainbridge | |
| 7,785,692 | B1 | 8/2010 | Siegel | |
| D637,318 | S | 5/2011 | Sawyer et al. | |
| D645,169 | S | 9/2011 | Runkles | |
| 8,236,392 | B2 | 8/2012 | Sawyer et al. | |
| 8,353,640 | B2 | 1/2013 | Sawyer | |
| 8,356,447 | B2 | 1/2013 | Lach | |
| 8,568,840 | B2 | 10/2013 | Sawyer et al. | |
| 8,597,754 | B2 | 12/2013 | Sawyer et al. | |
| 8,603,601 | B2 * | 12/2013 | Sawyer | E01C 3/003 428/44 |
| 8,662,787 | B2 | 3/2014 | Sawyer et al. | |
| 8,668,403 | B2 | 3/2014 | Sawyer | |
| 8,858,349 | B2 * | 10/2014 | Vachon | E01C 3/006 428/17 |
| 8,967,906 | B2 | 3/2015 | Sawyer | |
| 9,394,651 | B2 | 7/2016 | Sawyer | |
| 9,771,692 | B2 | 9/2017 | Sawyer et al. | |
| 9,790,646 | B2 | 10/2017 | Sawyer et al. | |
| 10,415,193 | B2 * | 9/2019 | Vachon | E01C 3/006 |
| D866,800 | S | 11/2019 | Runkles et al. | |
| D874,682 | S | 2/2020 | Vachon | |
| D886,333 | S | 6/2020 | Vachon | |
| 10,815,625 | B2 * | 10/2020 | De Maria | E01C 3/006 |
| 10,982,395 | B2 | 4/2021 | Sawyer et al. | |
| 11,047,094 | B2 | 6/2021 | Vachon | |
| 2003/0082005 | A1 * | 5/2003 | Scott | E01C 13/083 405/45 |
| 2008/0176010 | A1 * | 7/2008 | Sawyer | E01C 13/083 156/61 |
| 2009/0269517 | A1 * | 10/2009 | Karmie | B08B 3/04 428/17 |
| 2011/0173901 | A1 | 7/2011 | Runkles et al. | |
| 2013/0102403 | A1 | 4/2013 | Vachon | |
| 2015/0176225 | A1 | 6/2015 | Sawyer | |
| 2016/0265170 | A1 | 9/2016 | Vachon et al. | |
| 2018/0187429 | A1 | 7/2018 | Lim | |
| 2018/0237998 | A1 * | 8/2018 | Vachon | E01C 3/006 |
| 2019/0040592 | A1 * | 2/2019 | De Maria | E02D 31/025 |
| 2019/0203425 | A1 | 7/2019 | Sawyer et al. | |
| 2019/0376241 | A1 | 12/2019 | Vachon | |
| 2020/0002897 | A1 | 1/2020 | Vachon | |
| 2020/0063379 | A1 | 2/2020 | Sawyer et al. | |
| 2020/0070038 | A1 | 3/2020 | Vachon | |
| 2020/0181854 | A1 | 6/2020 | Vachon | |
| 2020/0181855 | A1 | 6/2020 | Vachon | |
| 2020/0299907 | A1 * | 9/2020 | van der Wende | E01C 3/006 |

OTHER PUBLICATIONS

Written Opinion for International Application No. PCT/IB2020/062289 mailed Jul. 1, 2021.
EP Supp search report 20905372.7 mailed Dec. 20, 2023.
CA Non-Final Office Action for 3,165,441 mailed Jan. 2, 2025.
CN First Office Action for 202080089782.4 mailed Jan. 26, 2025.

* cited by examiner

PADDING LAYER FOR ATHLETIC FIELD FOR WATER RETENTION AND DRAINAGE

CROSS-REFERENCE TO RELATED APPLICATIONS

This application is a national phase application under 35 U.S.C. § 371 of International Application No. PCT/IB2020/062289 filed Dec. 21, 2020, which claims the benefit of and priority to U.S. Provisional Patent Application No. 62/953,006 entitled "PADDING LAYER FOR ATHLETIC FIELD FOR WATER RETENTION AND DRAINAGE," filed Dec. 23, 2019, the contents of both of which being incorporated by reference in their entireties herein.

BACKGROUND

Shock pads and elastic layers for athletic fields are generally flat and follow the slope of any supporting infrastructure, such as a stone base or porous asphalt. If the supporting infrastructure is flat, sloped, or otherwise irregular, water repartition problems can occur. Generally, pads are designed to evacuate water as quickly as possible and are not intended to retain or accumulate water. The quick evacuation of water can cause pads or other layers to shift or otherwise provide insufficient stability.

TECHNICAL FIELD

The present disclosure relates to layers for athletic fields and, in particular, describes a panel having one or more water accumulation regions.

BRIEF SUMMARY OF THE INVENTION

A panel for use in a padding layer of a panel system is described that may be combined with other similar panels to form a padding layer of an athletic field, or other surface, as can be appreciated. In a first aspect, the panel for use in a padding layer of a panel system includes at least one water accumulation region positioned at or near a perimeter of the panel. The at least one water accumulation region is defined by a pyramidal surface that slopes downwards from a center of the panel to distal edges of the panel such that the center has a height relative to a ground surface greater than the distal edges of the panel, a plurality of projections projecting from the pyramidal surface, and a ridge projecting from the pyramidal surface. The ridge may extend along a perimeter of the panel, where the ridge has a projection height sufficient to retain water at the perimeter of the panel.

In some embodiments, a height of the ridge extending along the perimeter of the panel can be the same as a height of at least a portion of the plurality of projections. The pyramidal surface can include a first region having a first directional slope, a second region having a second directional slope, a third region having a third directional slope, and a fourth region having a fourth directional slope.

Further, the panel can include a horizontally-extending rib extending from a first side of the panel to a second side of the panel, and a vertically-extending rib extending from a third side of the panel to a fourth side of the panel. The first region can be defined as an area above the horizontally-extending rib and left of the vertically-extending rib, the second region can be defined as an area above the horizontally-extending rib and right of the vertically-extending rib, the third region can be defined as an area below the horizontally-extending rib and left of the vertically-extending rib, and the fourth region can be defined as an area below the horizontally-extending rib and right of the vertically-extending rib.

In some embodiments, the panel can include a plurality of drainage holes. The plurality of drainage holes can be positioned within individual ones of the plurality of projections or in water channels. In further embodiments, the projections positioned at the perimeter of the panel are formed integrally with the ridge. Various embodiments are also described including a method for providing or manufacturing the panel, where the panel is in accordance with one or more of the embodiments detailed herein.

In a second aspect, a panel for use in a padding layer of a panel system is described that comprises a generally flat surface, a plurality of water accumulation regions positioned on the flat surface, the plurality of water accumulation regions being defined by a horizontally-extending rib extending from a first side of the panel to a second side of the panel; a vertically-extending rib extending from a third side of the panel to a fourth side of the panel; and a ridge projecting from the flat surface, the ridge extending along a perimeter of the panel. The ridge has a projection height sufficient to retain water at the perimeter of the panel.

BRIEF DESCRIPTION OF THE DRAWINGS

Many aspects of the present disclosure can be better understood with reference to the following drawings. The components in the drawings are not necessarily to scale, with emphasis instead being placed upon clearly illustrating the principles of the disclosure. Moreover, in the drawings, like reference numerals designate corresponding parts throughout the several views.

DETAILED DESCRIPTION

Figure 1:
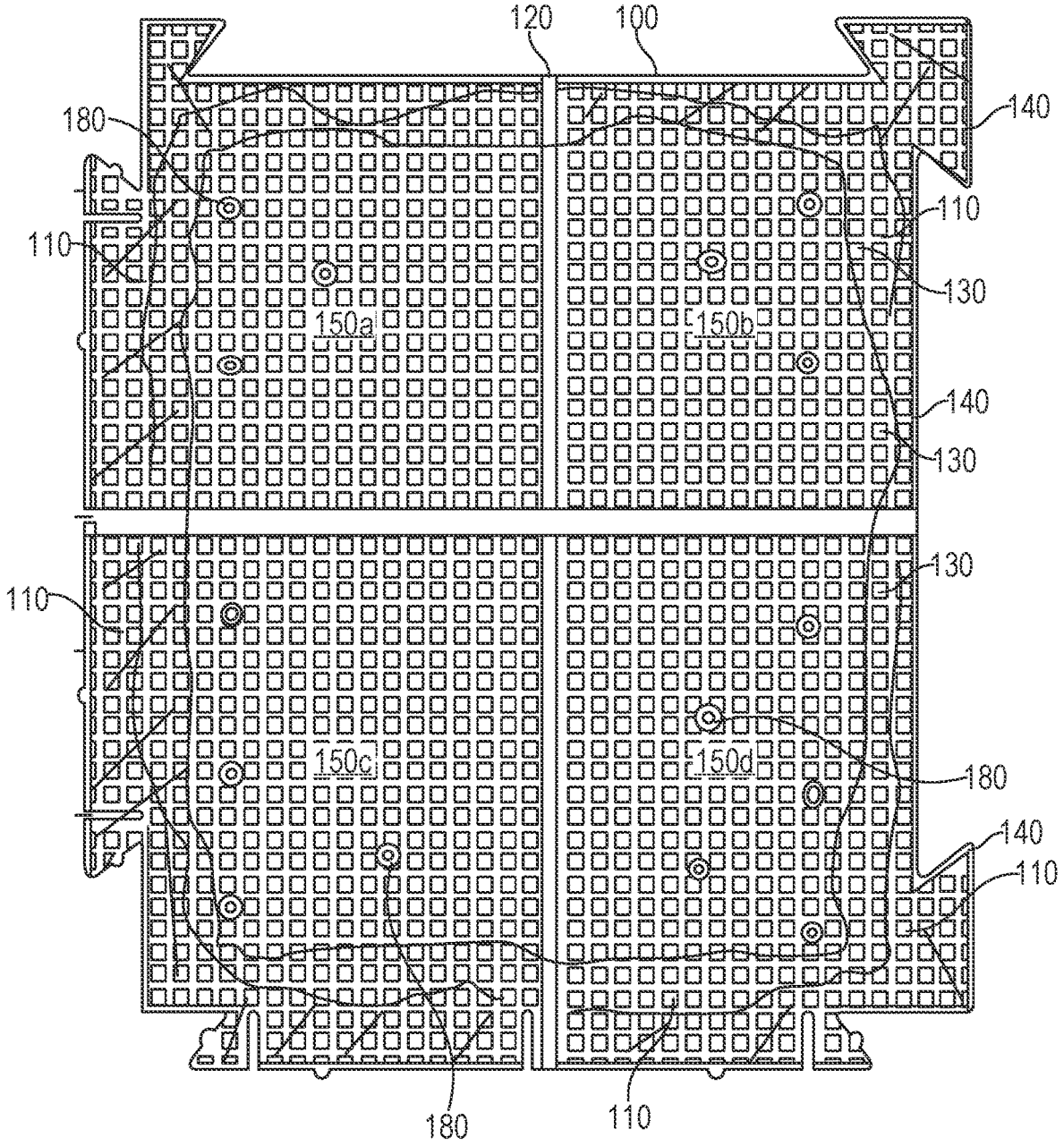
FIG. 1 is a top view of a top surface of a panel for use in a padding layer of an athletic field according to various embodiments of the present disclosure.

The present disclosure relates to a panel that can be implemented in a padding layer of an athletic field. As noted above, shock pads and elastic layers used in padding layers of athletic fields are generally flat and follow the slope of any supporting infrastructure, such as a stone base or porous asphalt. If the supporting infrastructure is flat, sloped, or otherwise irregular, water repartition problems can occur. However, current commercially available panels and pads are designed to evacuate water as quickly as possible, and are not intended to retain or accumulate water. The quick evacuation of water can cause pads or other layers to shift or otherwise provide insufficient stability of a playing field or other surface.

Accordingly, various embodiments are described herein for a panel for use in a padding layer of a panel system that may be combined with other similar panels to form a padding layer of an athletic field, sports surface, landscaping application, or other surface. The panel for use in a padding layer of a panel system includes at least one water accumulation region positioned at or near a perimeter of the panel. The at least one water accumulation region is defined by a pyramidal surface that slopes downwards from a center of the panel to distal edges of the panel such that the center has a height relative to a ground surface greater than the distal edges of the panel, a plurality of projections projecting from the pyramidal surface, and a ridge projecting from the pyramidal surface, the ridge extending along a perimeter of the panel. The ridge has a projection height sufficient to retain water at the perimeter of the panel. Some of the water accumulation regions may dissipate water at a lower rate than other regions in various embodiments.

In some embodiments, a height of the ridge extending along the perimeter of the panel can be the same as a height of at least a portion of the plurality of projections. The pyramidal surface can include a first region having a first directional slope, a second region having a second directional slope, a third region having a third directional slope, and a fourth region having a fourth directional slope.

Further, the panel can include a horizontally-extending rib extending from a first side of the panel to a second side of the panel, and a vertically-extending rib extending from a third side of the panel to a fourth side of the panel. The first region can be defined as an area above the horizontally-extending rib and left of the vertically-extending rib. The second region can be defined as an area above the horizontally-extending rib and right of the vertically-extending rib. The third region can be defined as an area below the horizontally-extending rib and left of the vertically-extending rib. The fourth region can be defined as an area below the horizontally-extending rib and right of the vertically-extending rib. The panel may include further regions in various embodiments.

In some embodiments, the panel can include a plurality of drainage holes. The plurality of drainage holes can be positioned within individual ones of the plurality of projections or in water channels. In further embodiments, the projections positioned at the perimeter of the panel are formed integral with the ridge. Various embodiments are also described including a method for providing or manufacturing the panel, where the panel is in accordance with one or more of the embodiments detailed herein.

A padding layer can include a multitude of abutting panels (also referred to as "pads") that may be realized through use of the padding layer, which may enhance water drainage, provide heat management, provide ease of assembly and installation, durability, longevity, uniformity, and resistance to change in weather according to seasons, all while maintaining safety.

Turning now to FIG. 1, a top view of an embodiment of a panel 100 is shown according to various embodiments. It is understood that the panel 100 may resolve the problem of water repartitioning by having one or more water accumulation regions 110. The panel 100 may overflow water from the one or more water accumulation regions 110 when the one or more water accumulation regions 110 are oversaturated with water or other liquid. More specifically, the panel 100 can include at least one water accumulation region 110 positioned at or near a perimeter of the panel 100, as shown in FIG. 1. The at least one water accumulation region 110 can be defined by a shape and position of the panel 100, as can be appreciated. The panel 100 may be formed of a closed-cell, hydrophobic material in some embodiments.

For instance, the panel 100 can include a pyramidal surface 120 (or "a pyramidal top surface") that slopes downwards from a center of the panel 100 to distal edges of the panel 100 such that the center has a height relative to a ground surface greater than the distal edges of the panel 100. In other words, referring to a central portion of the panel 100, the panel 100 may slope downwards towards a top of the panel 100, downwards towards a bottom of the panel 100, downwards towards a left side of the panel 100, and/or downwards towards a right side of the panel 100. While embodiments described herein relate to a pyramidal surface 120 having four slopes, it is understood that in some embodiments, the pyramidal surface 120 may have three slopes or other desired number of slopes. Additionally embodiments, described below, include a panel 100 that is generally flat having no slopes.

Further, the panel 100 can include a plurality of projections 130 projecting from the pyramidal surface 120 and a ridge 140 projecting from the pyramidal surface 120. The projections 130 may come into contact with a turf layer or a bottom of a synthetic turf surface, as can be appreciated. As shown in FIG. 1, the ridge 140 can extend along a perimeter of the panel 100. In some embodiments, the ridge 140 has a projection height or, in other words, a height from the pyramidal surface 120 sufficient to retain water at the perimeter of the panel 100, for instance, at the water accumulation regions 110. In some embodiments, a height of the ridge 140 extending along the perimeter of the panel 100 can be the same as a height of at least a portion of the plurality of projections 130.

Figure 2:
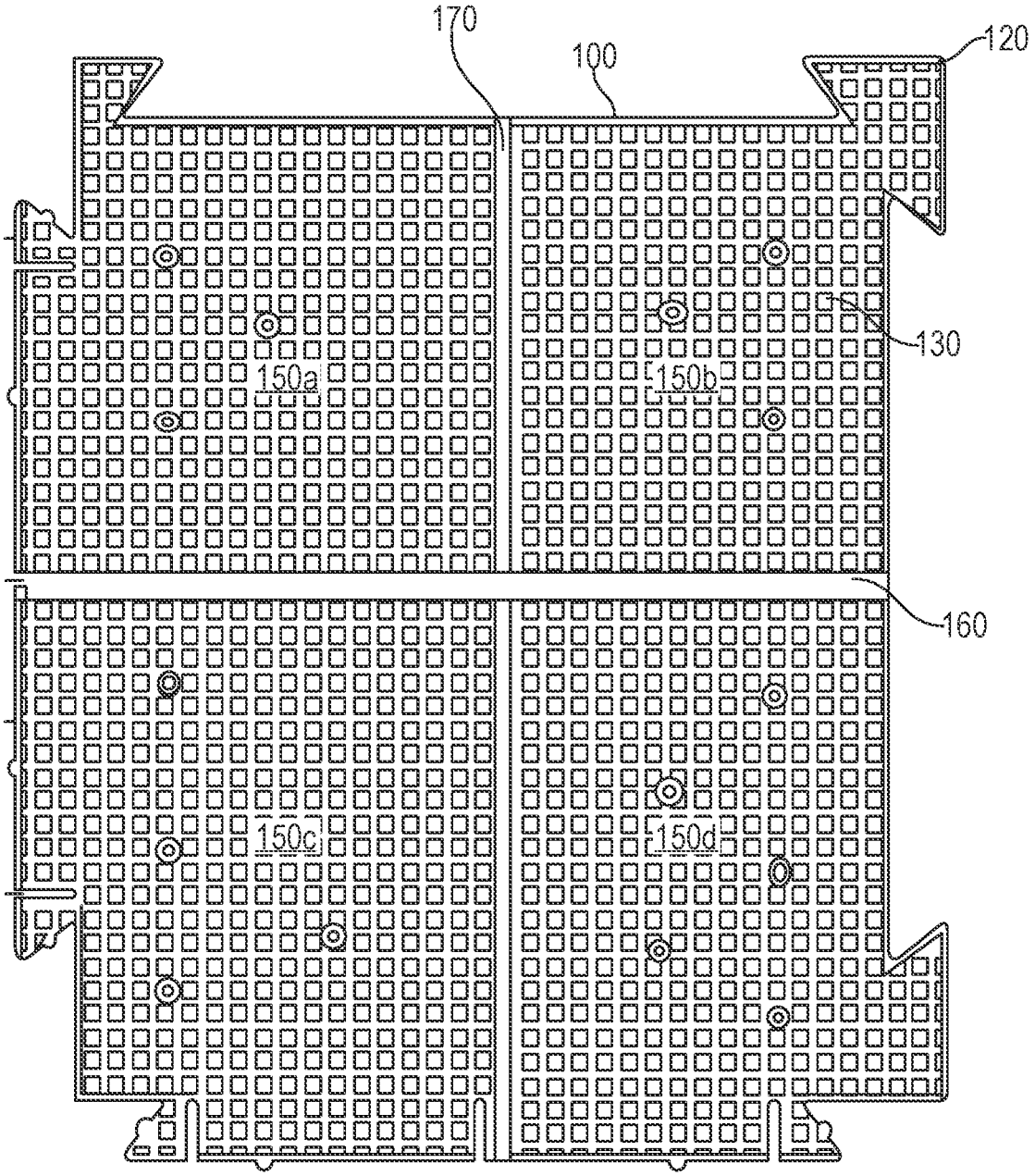
FIG. 2 is another top view of the top surface of the panel for use in a padding layer of an athletic field according to various embodiments of the present disclosure.

Moving on to FIG. 2, another top view of an embodiment of a panel 100 is shown in accordance with various embodiments. As shown in FIGS. 1 and 2, collectively, the pyramidal surface 120 of the panel 100 can include a first region 150*a* having a first directional slope, a second region 150*b* having a second directional slope, a third region 150*c* having a third directional slope, and a fourth region 150*d* having a fourth directional slope, where the directional slopes in each of the regions 150 are distinct from one another.

The panel 100 can include a horizontally-extending rib 160 extending from a first side (e.g., a left side) of the panel 100 to a second side (e.g., a right side) of the panel 100. Further, the panel 100 can include a vertically-extending rib 170 extending from a third side (e.g., a top side) of the panel 100 to a fourth side (e.g., a bottom side) of the panel 100. The horizontally-extending rib 160 and the vertically-extending rib 170 overlap to provide the four regions 150.

For instance, the first region 150*a* can be defined as an area above the horizontally-extending rib 160 and left of the vertically-extending rib 170. The second region 150*b* can be defined as an area above the horizontally-extending rib 160 and right of the vertically-extending rib 170. The third region 150*c* can be defined as an area below the horizontally-extending rib 160 and left of the vertically-extending rib 170. Finally, the fourth region 150*d* can be defined as an area below the horizontally-extending rib 160 and right of the vertically-extending rib 170.

Referring back to FIG. 1, in some embodiments, the panel 100 can include a plurality of drainage holes 180. In some embodiments, the plurality of drainage holes 180 can be positioned within individual ones of the plurality of projections 130 such that the drainage holes 180 are not positioned in water channels. However, in additional embodiments, the plurality of drainage holes 180 can be positioned within water channels.

Figure 3:
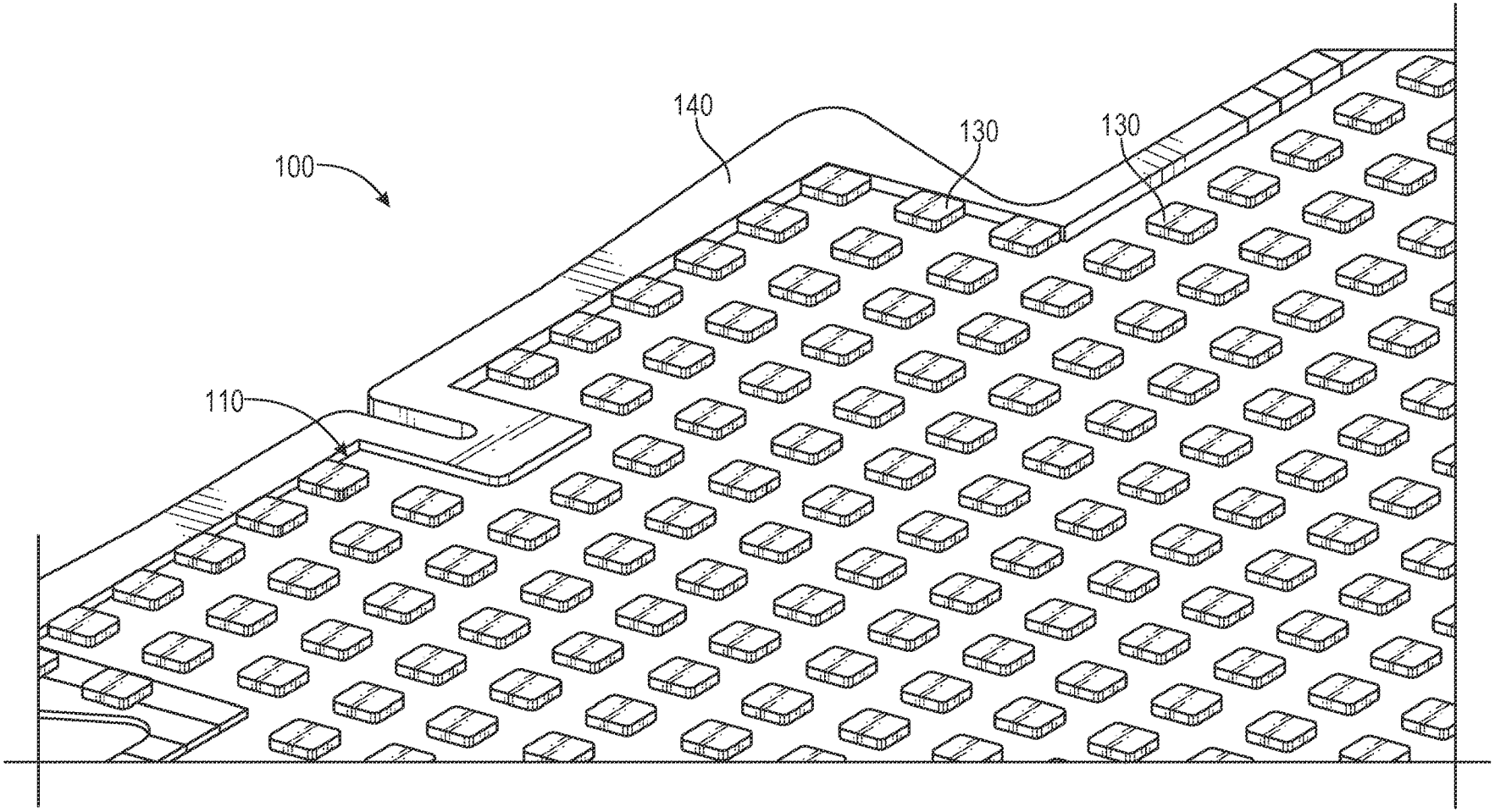
FIG. 3 is a top perspective view of the top surface of the panel for use in a padding layer of an athletic field according to various embodiments of the present disclosure.

Moving along to FIG. 3, a perspective view of a portion of the panel 100 is shown. As noted above, the panel 100 can include a plurality of projections 130 projecting from the pyramidal surface 120 and a ridge 140 projecting from the pyramidal surface 120. As shown in FIG. 3, the ridge 140 can extend along a perimeter of the panel 100. In some embodiments, the ridge 140 has a projection height or, in other words, a height from the pyramidal surface 120 sufficient to retain water at the perimeter of the panel 100, for instance, at the water accumulation regions 110. Also shown in FIG. 3, in some embodiments, a height of the ridge 140 extending along the perimeter of the panel 100 can be the same as a height of at least a portion of the plurality of projections 130. In further embodiments, a portion of the projections 130, such as those positioned at the perimeter of the panel 100, can be formed integral with the ridge 140.

Figure 4:
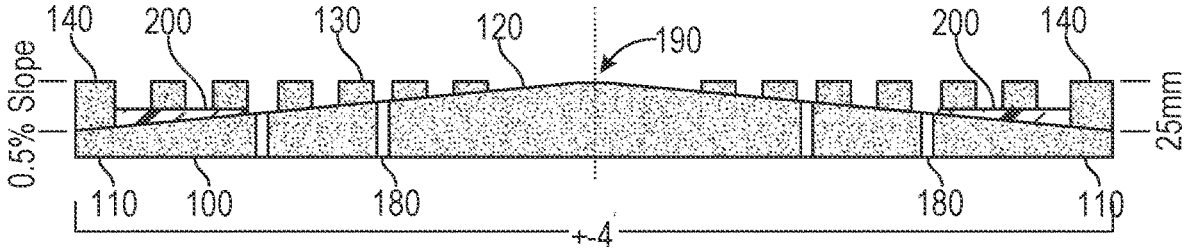
FIG. 4 is a side cross-section view of the panel for use in a padding layer of an athletic field according to various embodiments of the present disclosure.

Referring now to FIG. 4, a side cross-section view of a portion of the panel 100 is shown. As noted above, the panel 100 can include a plurality of projections 130 projecting from the pyramidal surface 120, and a ridge 140 projecting from the pyramidal surface 120. A center 190 (e.g., a top center) of the panel is shown. Also shown in FIG. 4, the ridge 140 can extend along a perimeter of the panel 100. In some embodiments, the ridge 140 has a projection height or, in other words, a height from the pyramidal surface 120 sufficient to retain water 200 at the perimeter of the panel 100, for instance, at the water accumulation regions 110. Also shown in FIG. 3, in some embodiments, a height of the ridge 140 extending along the perimeter of the panel 100 can be the same as a height of at least a portion of the plurality of projections 130. In further embodiments, a portion of the projections 130, such as those positioned at the perimeter of the panel 100, can be formed integral with the ridge 140.

Figure 5:
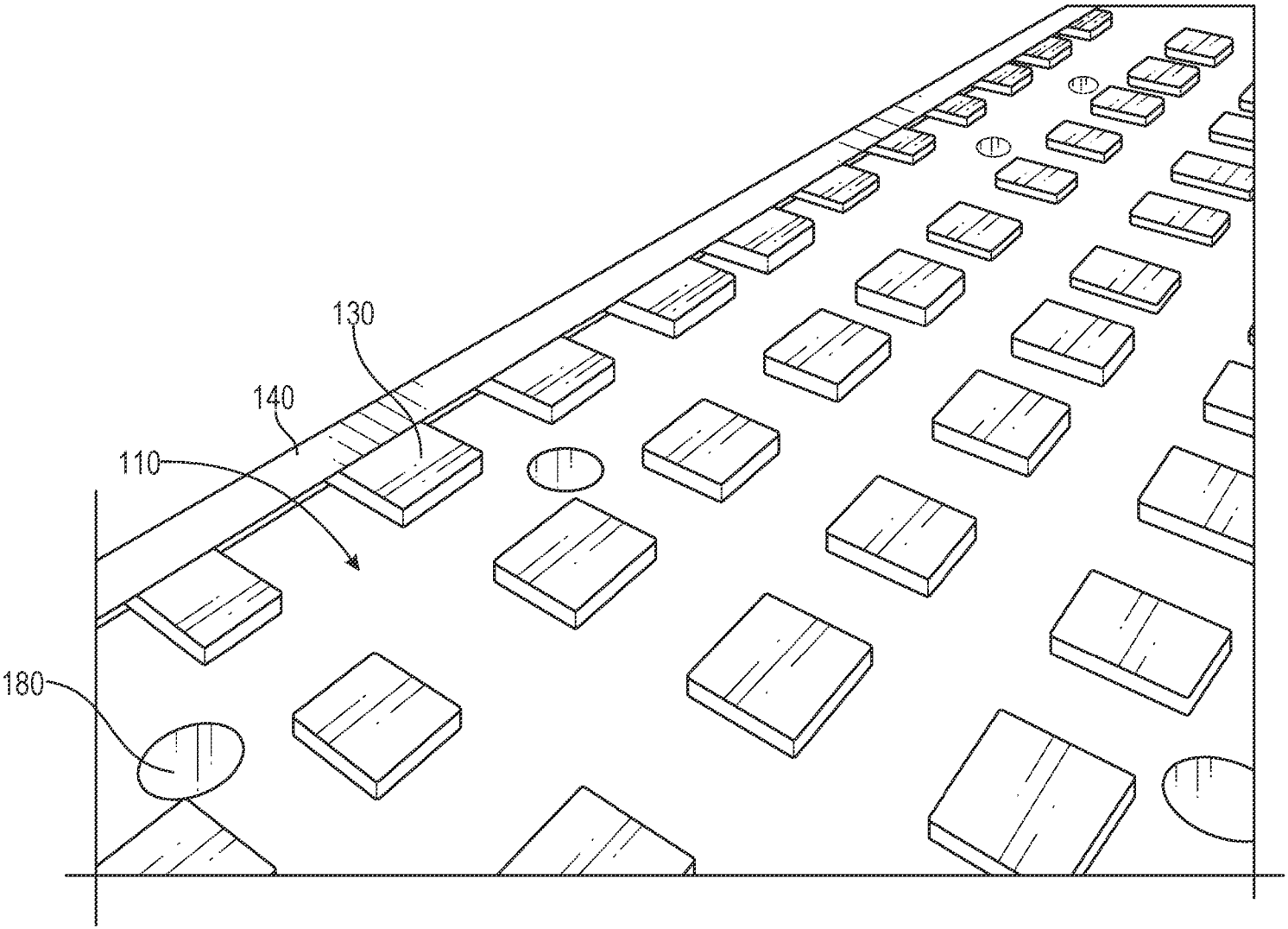
FIG. 5 is another top perspective view of the top surface of the panel for use in a padding layer of an athletic field according to various embodiments of the present disclosure.
Figure 6:
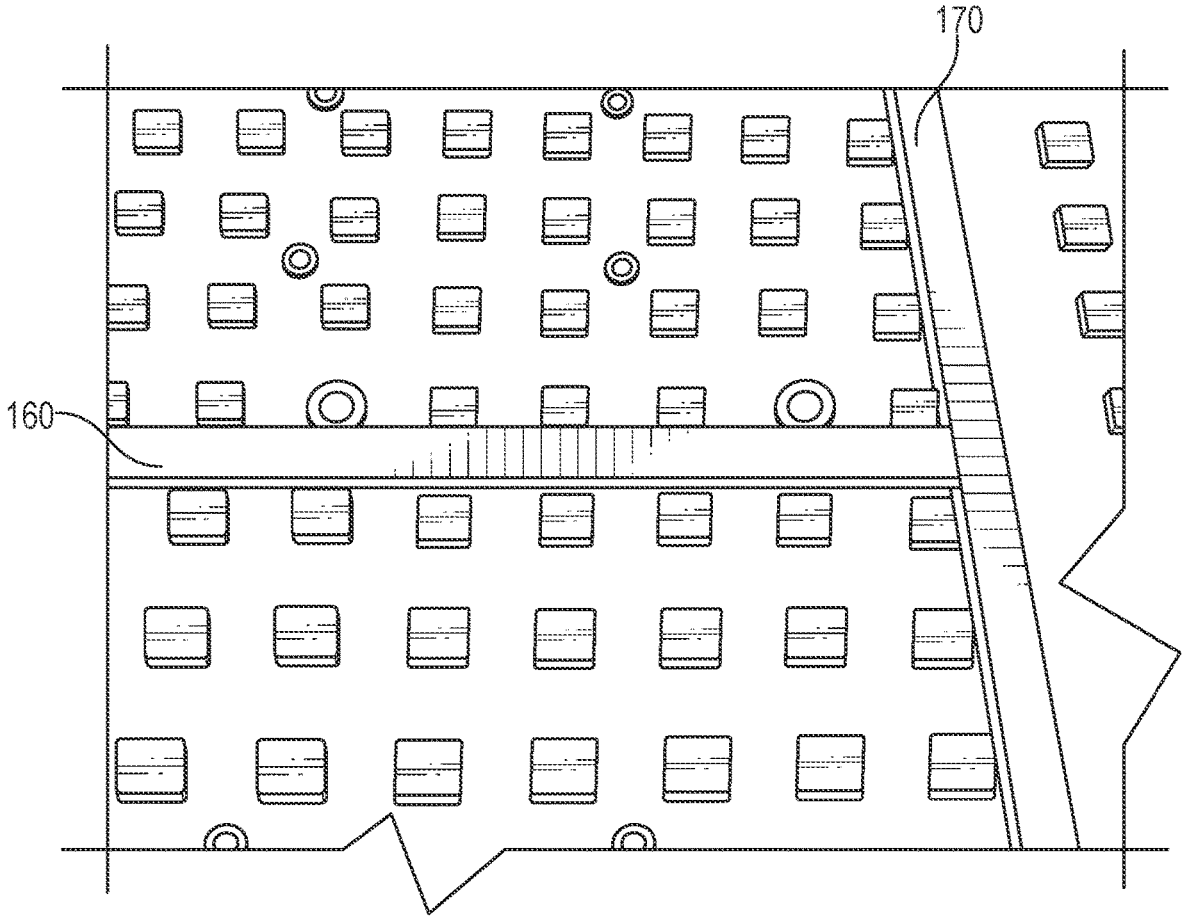
FIG. 6 is a top view of the top surface of the panel for use in a padding layer of an athletic field according to various embodiments of the present disclosure.
Figure 7:
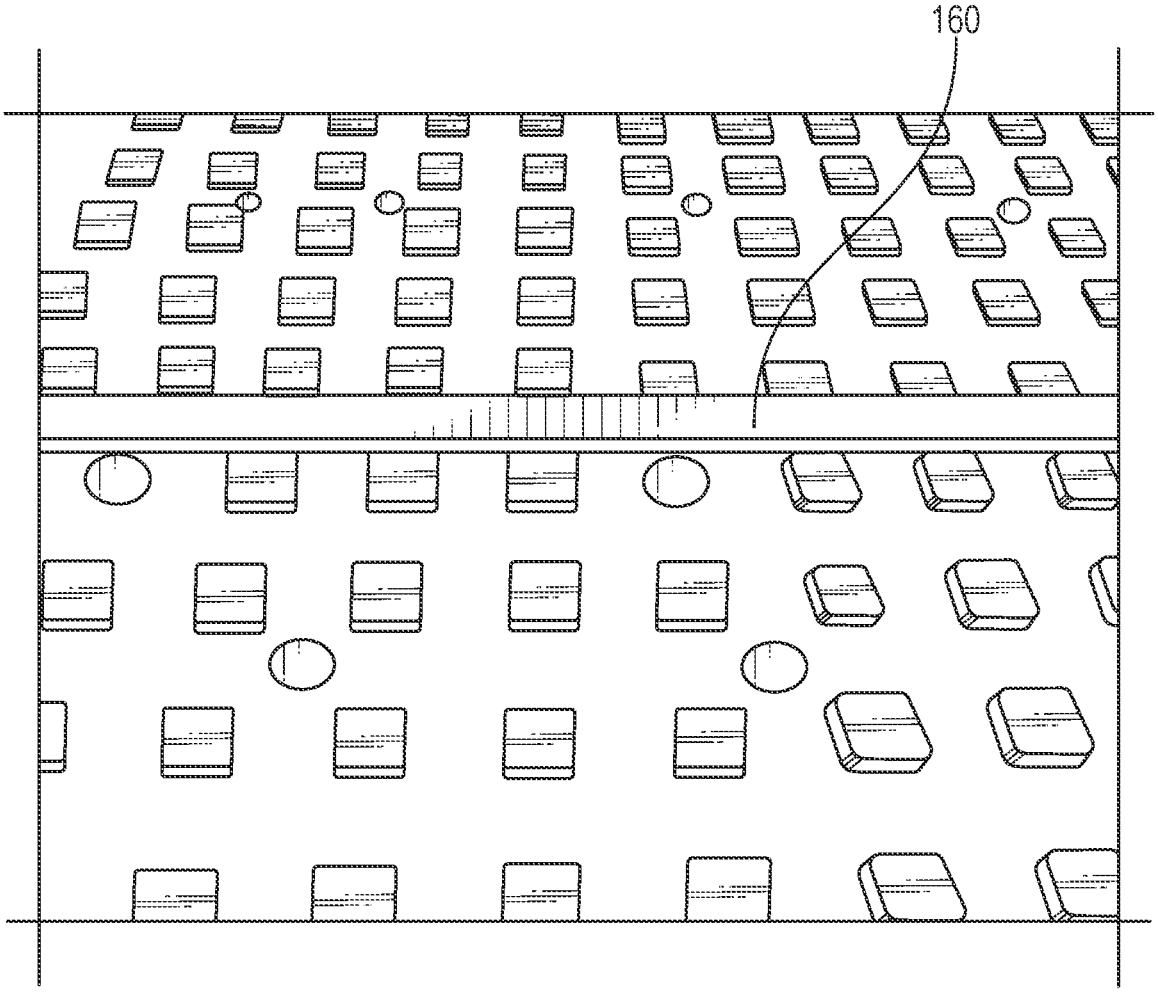
FIG. 7 is a top perspective view of the top surface of the panel for use in a padding layer of an athletic field according to various embodiments of the present disclosure.

Additional views and embodiments of the panel 100 and the components described above are shown in FIGS. 5-9, which include various top perspective views showing the pyramidal surface 120 of the panel 100, among other features. Notably, in FIG. 5, the ridge 140 is shown along the perimeter of the panel 100 that prevents water evacuation at the perimeter or edge of the panel 100 until the water level of the panel 100 (or respective region 150 of the panel 100) exceeds a predefined level.

In various embodiments, the panel 100 may have an inclination (an angle of incline) from a center 190 of the panel 100 to the edges of the panel 100 of approximately 0.25% to 1%, for instance, to facilitate water evacuation to the edges of the panel 100. In other words, the panel 100 may have a height at the edges of the panel 100 being 0.25% to 1% less than a height of the panel at the center 190. In FIG. 4, a non-limiting example of an inclination of 0.5% is shown, meaning the panel 100 may have a height at the edges of the panel 100 being 0.5% less than a height of the panel at the center 190 (e.g., 25 mm).

The panel 100 may include a top surface having a plurality of top-side projections 130 that couple to or create an interference or friction fit with a surface layer (not shown), which can include an artificial turf field layer, or other similar layer. In various embodiments, as shown in FIG. 4, the top-side projections 130 can gradually increase or decrease in height depending, for example, on their location on the panel 100. In other words, a respective one of the top-side projections 130 may be a function of its distance from an edge (or the center 190) of the panel 100.

Figure 8:
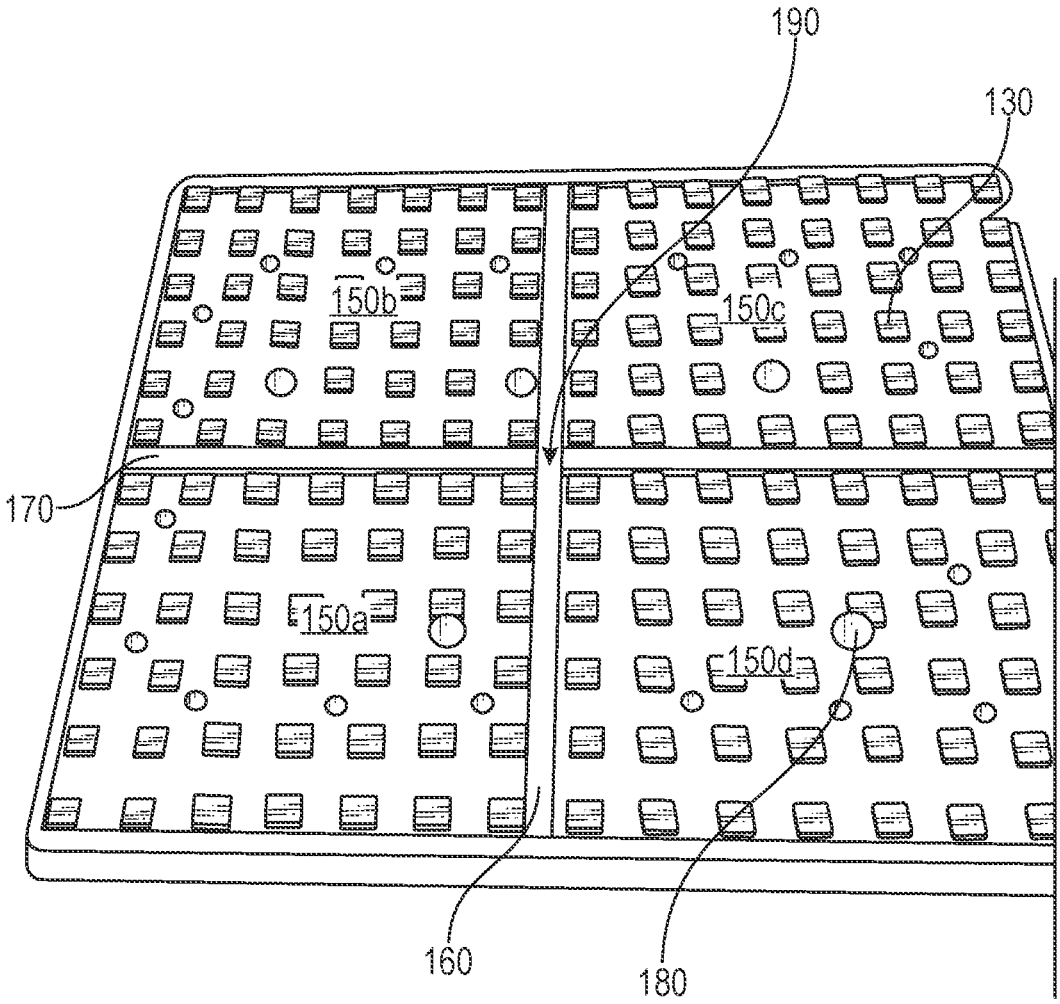
FIG. 8 is another top perspective view of the top surface of the panel for use in a padding layer of an athletic field according to various embodiments of the present disclosure.
Figure 9:
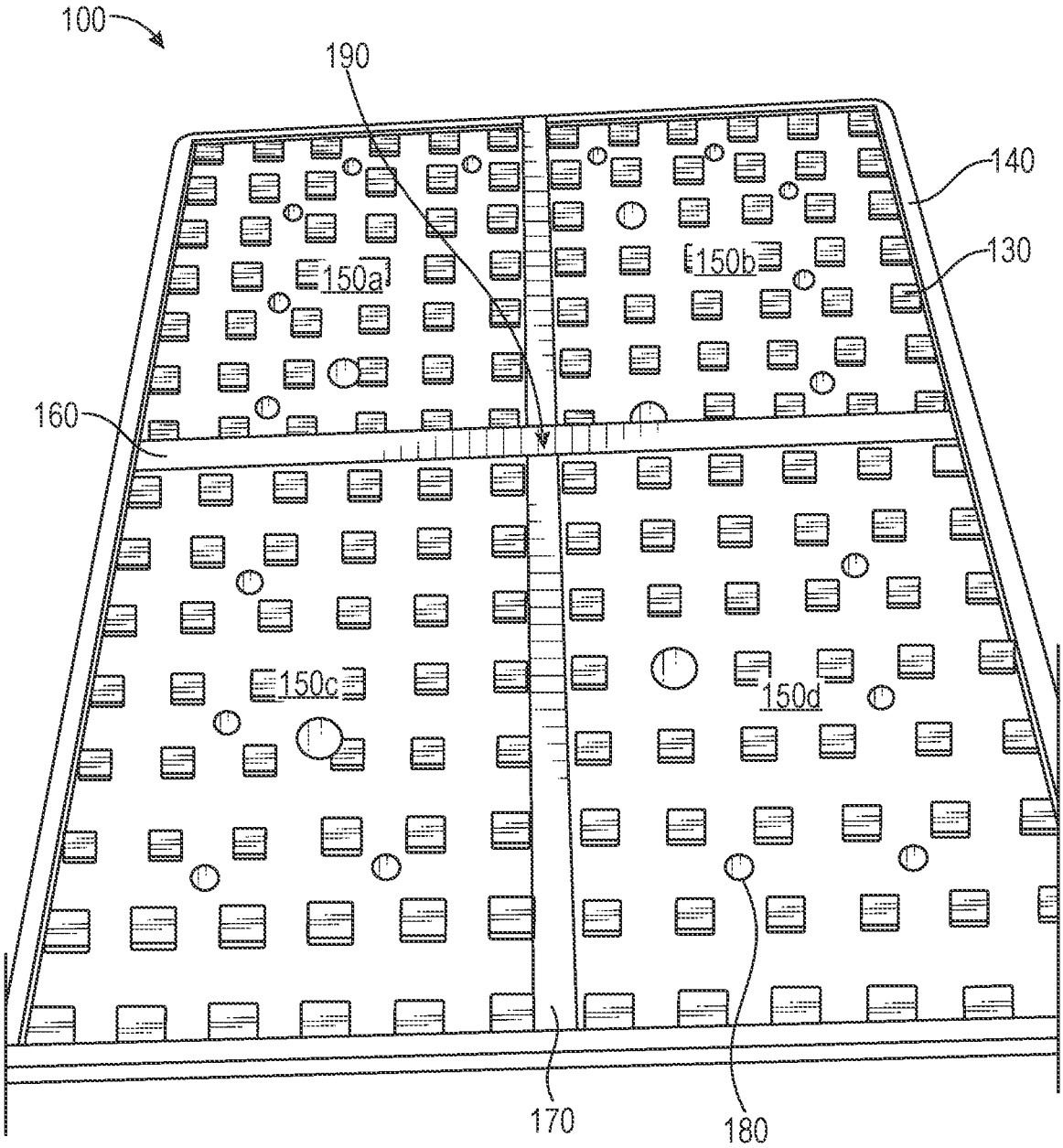
FIG. 9 is another top perspective view of the top surface of the panel for use in a padding layer of an athletic field according to various embodiments of the present disclosure.

By virtue of the varied heights of the top-side projections 130 on the sloping surface, the top-side projections 130 may have tops capable of forming a flat support for an artificial turf or other top surfaces. In some embodiments, the top-side projections 130 may include a predetermined space (e.g., ¾" or ⅜") between one another to optimize turf (or other top layer) stability. Inclination may be formed in one direction or in both directions to form a shape of a rectangular-based pyramid, as shown in FIG. 1, FIG. 8, and FIG. 9.

In some embodiments, the panel 100 may be formed of one or more of nanocellulose (e.g., nanocellulose beads), expanded polypropylene (EPP), hybrid expanded polypropylene EPP (HEPP), a mix of an expanded polypropylene (EPP) with an expanded polyethylene (EPE) or polyethylene (PE), and a rubber material. In some embodiments, a first side of the panel 100 is symmetrical to a second side of the panel 100, as shown in FIG. 1. Further, in some embodiments, the center 190 may have a flat surface (e.g., not having a slope).

As may be appreciated, it is beneficial to evacuate water as soon as possible as many types of materials that make up the panel 100 absorb moisture. For instance, some types of padding materials have properties that change when the material is damp or saturated. Because embodiments described herein may include a panel 100 formed of a closed-cell, hydrophobic material that doesn't absorb moisture (e.g., nanocellulose), in some embodiments, the panel 100 may include internal recesses, referred to herein as a water accumulation region 110. Once the water accumulation regions 110 are full, water can be evacuated using the drainage holes 180 or the water accumulation regions 110 may act as a water retention basin.

In hot temperatures, moisture will be evacuated from the water traps and a field supported by the panel 100, as well as other components of the system, may cool down in temperature. The water accumulation regions 110 may be positioned in various locations of the panel 100, for instance, along a perimeter of the panel 100 adjacent to the ridge 140.

In further embodiments, the panel 100 may include a flat panel not having a slope. However, the panel 100 includes the ridge 140 that retains moisture within the panel 100 (e.g., within regions 150 of the panel 100). For instance, the panel 100 may include the ridge 140, the horizontally-extending rib 160, and the vertically-extending rib 170, thereby defining the regions 150 described above.

The features, structures, or characteristics described above may be combined in one or more embodiments in any suitable manner, and the features discussed in the various embodiments are interchangeable, if possible. In the foregoing description, numerous specific details are provided in order to fully understand the embodiments of the present disclosure. However, a person skilled in the art will appreciate that the technical solution of the present disclosure may be practiced without one or more of the specific details, or other methods, components, materials, and the like may be employed. In other instances, well-known structures, materials, or operations are not shown or described in detail to avoid obscuring aspects of the present disclosure.

Although the relative terms such as "on," "below," "upper," and "lower" are used in the specification to describe the relative relationship of one component to another component, these terms are used in this specification for convenience only, for example, as a direction in an example shown in the drawings. It should be understood that if the device is turned upside down, the "upper" component described above will become a "lower" component. When a structure is "on" another structure, it is possible that the structure is integrally formed on another structure, or that the structure is "directly" disposed on another structure, or that the structure is "indirectly" disposed on the other structure through other structures.

In this specification, the terms such as "a," "an," "the," and "said" are used to indicate the presence of one or more elements and components. The terms "comprise," "include," "have," "contain," and their variants are used to be open ended, and are meant to include additional elements, components, etc., in addition to the listed elements, components, etc. unless otherwise specified in the appended claims. The terms "first," "second," etc. are used only as labels, rather than a limitation for a number of the objects.

The above-described embodiments of the present disclosure are merely possible examples of implementations set forth for a clear understanding of the principles of the disclosure. Many variations and modifications may be made to the above-described embodiment(s) without departing substantially from the spirit and principles of the disclosure. All such modifications and variations are intended to be included herein within the scope of this disclosure and protected by the following claims.

Clause 1. A panel for use in a padding layer of a panel system, comprising: at least one water accumulation region positioned at or near a perimeter of the panel, the at least one water accumulation region being defined by: a pyramidal surface that slopes downwards from a center of the panel to distal edges of the panel such that the center has a height relative to a ground surface greater than the distal edges of the panel; a plurality of projections projecting from the pyramidal surface; and a ridge projecting from the pyramidal surface, the ridge extending along a perimeter of the panel, wherein the ridge has a projection height sufficient to retain water at the perimeter of the panel.

Clause 2. The panel of clause 1, wherein a height of the ridge extending along the perimeter of the panel is the same as a height of at least a portion of the plurality of projections.

Clause 3. The panel of clauses 1-2, wherein the pyramidal surface comprises a first region having a first directional slope, a second region having a second directional slope, a third region having a third directional slope, and a fourth region having a fourth directional slope being distinct relative to one another.

Clause 4. The panel of clauses 1-3, further comprising: a horizontally-extending rib extending from a first side of the panel to a second side of the panel; and a vertically-extending rib extending from a third side of the panel to a fourth side of the panel.

Clause 5. The panel of clauses 1-4, wherein: the first region is defined as an area above the horizontally-extending rib and left of the vertically-extending rib; the second region is defined as an area above the horizontally-extending rib and right of the vertically-extending rib; the third region is defined as an area below the horizontally-extending rib and left of the vertically-extending rib; and the fourth region is defined as an area below the horizontally-extending rib and right of the vertically-extending rib.

Clause 6. The panel of clauses 1-5, further comprising a plurality of drainage holes.

Clause 7. The panel of clauses 1-6, wherein the plurality of drainage holes are positioned within individual ones of the plurality of projections.

Clause 8. The panel of clauses 1-7, wherein the plurality of projections positioned at the perimeter of the panel are formed integral with the ridge.

Clause 9. The panel of clauses 1-8, wherein the panel is formed of a closed-cell, hydrophobic material.

Clause 10. A method, comprising: providing a panel for use in a padding layer of a panel system, wherein the panel comprises: at least one water accumulation region positioned at or near a perimeter of the panel, the at least one water accumulation region being defined by: a pyramidal surface that slopes downwards from a center of the panel to distal edges of the panel such that the center has a height relative to a ground surface greater than the distal edges of the panel; a plurality of projections projecting from the pyramidal surface; and a ridge projecting from the pyramidal surface, the ridge extending along a perimeter of the panel, wherein the ridge has a projection height sufficient to retain water at the perimeter of the panel.

Clause 11. The method of clause 10, wherein: a height of the ridge extending along the perimeter of the panel is the same as a height of at least a portion of the plurality of projections; and the pyramidal surface comprises a first region having a first directional slope, a second region having a second directional slope, a third region having a third directional slope, and a fourth region having a fourth directional slope being distinct relative to one another.

Clause 12. The method of clauses 10-11, further comprising: a horizontally-extending rib extending from a first side of the panel to a second side of the panel; a vertically-extending rib extending from a third side of the panel to a fourth side of the panel, wherein: the first region is defined as an area above the horizontally-extending rib and left of the vertically-extending rib; the second region is defined as an area above the horizontally-extending rib and right of the vertically-extending rib; the third region is defined as an area below the horizontally-extending rib and left of the vertically-extending rib; and the fourth region is defined as an area below the horizontally-extending rib and right of the vertically-extending rib.

Clause 13. The method of clauses 10-12, further comprising a plurality of drainage holes positioned within individual ones of the plurality of projections.

Clause 14. The method of clauses 10-13, wherein the plurality of projections positioned at the perimeter of the panel are formed integral with the ridge.

Clause 15. The method of clauses 10-14, further comprising forming the panel of a closed-cell, hydrophobic material.

Clause 16. A panel for use in a padding layer of a panel system, comprising: a flat surface; a plurality of water accumulation regions positioned on the flat surface, the plurality of water accumulation regions being defined by: a horizontally-extending rib extending from a first side of the panel to a second side of the panel; a vertically-extending rib extending from a third side of the panel to a fourth side of the panel; and a ridge projecting from the flat surface, the ridge extending along a perimeter of the panel, wherein the ridge has a projection height sufficient to retain water at the perimeter of the panel.

Therefore, the following is claimed:

1. A panel for use in a padding layer of a panel system, comprising:

at least one water accumulation region positioned at or near a perimeter of the panel, the at least one water accumulation region being defined by:

a pyramidal surface that slopes downwards from a center of the panel to distal edges of the panel such that the center has a height relative to a ground surface greater than the distal edges of the panel;

a plurality of projections projecting from the pyramidal surface; and a ridge projecting from the pyramidal surface, the ridge extending along a perimeter of the panel and formed integrally with at least a portion of the plurality of projections positioned at or near the perimeter of the panel, wherein the ridge has a projection height sufficient to retain water at the perimeter of the panel.

2. The panel of claim 1, wherein a height of the ridge extending along the perimeter of the panel is the same as a height of at least a portion of the plurality of projections.

3. The panel of claim 1, wherein the pyramidal surface comprises a first region having a first directional slope, a second region having a second directional slope, a third region having a third directional slope, and a fourth region having a fourth directional slope being distinct relative to one another.

4. The panel of claim 3, further comprising:

a horizontally-extending rib extending from a first side of the panel to a second side of the panel; and a vertically-extending rib extending from a third side of the panel to a fourth side of the panel.

5. The panel of claim 4, wherein:

the first region is defined as an area above the horizontally-extending rib and left of the vertically-extending rib;

the second region is defined as an area above the horizontally-extending rib and right of the vertically-extending rib;

the third region is defined as an area below the horizontally-extending rib and left of the vertically-extending rib; and the fourth region is defined as an area below the horizontally-extending rib and right of the vertically-extending rib.

6. The panel of claim 1, further comprising a plurality of drainage holes.

7. The panel of claim 6, wherein the plurality of drainage holes are positioned within individual ones of the plurality of projections.

8. The panel of claim 1, wherein the panel is formed of a closed-cell, hydrophobic material.

9. A method, comprising:

providing the panel for use in the padding layer of the panel system according to claim 1.

10. The method of claim 9, wherein:

a height of the ridge extending along the perimeter of the panel is the same as a height of at least a portion of the plurality of projections; and the pyramidal surface comprises a first region having a first directional slope, a second region having a second directional slope, a third region having a third directional slope, and a fourth region having a fourth directional slope being distinct relative to one another.

11. The method of claim 10, further comprising:

a horizontally-extending rib extending from a first side of the panel to a second side of the panel;

a vertically-extending rib extending from a third side of the panel to a fourth side of the panel, wherein:

the first region is defined as an area above the horizontally-extending rib and left of the vertically-extending rib;

the second region is defined as an area above the horizontally-extending rib and right of the vertically-extending rib;

the third region is defined as an area below the horizontally-extending rib and left of the vertically-extending rib; and the fourth region is defined as an area below the horizontally-extending rib and right of the vertically-extending rib.

12. The method of claim 9, wherein the panel further comprises a plurality of drainage holes positioned within individual ones of the plurality of projections, and wherein the method further comprises forming the panel of a closed-cell, hydrophobic material.

13. A panel for use in a padding layer of a panel system, comprising:

a flat surface;

at least one water accumulation region positioned at or near a perimeter of the panel, the at least one water accumulation region being defined by:

a plurality of projections projecting from a pyramidal surface; and a ridge projecting from the pyramidal surface, the ridge extending along a perimeter of the panel and formed integrally with at least a portion of the plurality of projections positioned at or near the perimeter of the panel, wherein the ridge has a projection height sufficient to retain water at the perimeter of the panel.

14. A panel for use in a padding layer of a panel system, comprising:

a flat surface;

a plurality of water accumulation regions positioned on the flat surface, the plurality of water accumulation regions being defined by:

a horizontally-extending rib extending from a first side of the panel to a second side of the panel;

a vertically-extending rib extending from a third side of the panel to a fourth side of the panel; and a ridge projecting from the flat surface, the ridge extending along a perimeter of the panel, wherein the ridge has a projection height sufficient to retain water at the perimeter of the panel and wherein the projection height is the same as a height of at least a portion of a projection projecting from the flat surface.

15. The panel of claim 1, wherein individual ones of the plurality of projections gradually increase in height from near the center of the panel to the distal edges of the panel.

* * * * *